US011345448B2

(12) United States Patent
Milne et al.

(10) Patent No.: US 11,345,448 B2
(45) Date of Patent: May 31, 2022

(54) FIN FIXING SYSTEM

(71) Applicants: John DeCourcey Milne, Brisbane (AU); Tyler Stokes Callaway, Del Mar, CA (US)

(72) Inventors: John DeCourcey Milne, Brisbane (AU); Tyler Stokes Callaway, Del Mar, CA (US)

( * ) Notice: Subject to any disclaimer, the term of this patent is extended or adjusted under 35 U.S.C. 154(b) by 74 days.

(21) Appl. No.: 17/062,843

(22) Filed: Oct. 5, 2020

(65) Prior Publication Data

US 2021/0016858 A1 Jan. 21, 2021

Related U.S. Application Data

(63) Continuation-in-part of application No. 16/438,222, filed on Jun. 11, 2019, now Pat. No. 10,793,234.

(51) Int. Cl.
*B63B 32/64* (2020.01)
*B63B 32/66* (2020.01)

(52) U.S. Cl.
CPC ..... *B63B 32/64* (2020.02); *B63B 32/66* (2020.02)

(58) Field of Classification Search
CPC ... B63B 35/79; B63B 35/793; B63B 35/7906; B63B 35/7926; B63B 32/20; B63B 32/60; B63B 32/64; B63B 32/66
USPC ..... 441/79
See application file for complete search history.

(56) References Cited

U.S. PATENT DOCUMENTS 5,493,989 A * 2/1996 Anderson ..... B63B 32/66 441/79
9,688,365 B2 * 6/2017 Norrie ..... B63B 32/66
10,793,234 B2 * 10/2020 Milne ..... B63B 32/66

* cited by examiner

*Primary Examiner* — Lars A Olson
(74) *Attorney, Agent, or Firm* — Eric Hanscom

(57) ABSTRACT

This invention is directed toward a fin box capable of accepting either a Futures® or an FCS® fin without the need for any additional products being added to either the fins or the fin box. The box has an internally-adjustable wedge that can force the bottom of a fin into an indent, thereby giving it a cant or angle. The box also has channels for both FCS® and Futures® fins, such that a user can easily exchange either brand of fin without adding or subtracting items from the fins or fin boxes. Another embodiment of the invention provides a fin base with a wedge angle that compresses an underlying wedge, thereby "wedging" the fin in the fin box. A further embodiment has a button on the fin that compresses a springy material as it passes over a fin box lip, thereby removably securing the fin in the fin box.

17 Claims, 17 Drawing Sheets

FIN FIXING SYSTEM

CROSS REFERENCE TO RELATED APPLICATIONS

This application claims priority back to, and is a continuation-in-part of, U.S. Utility Ser. No. 16/438,222 filed Jun. 11, 2019, entitled Fin Fixing System, the contents of which are incorporated by reference into this application.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of surfing and surfboard fins, and more specifically to a fin fixing system that will allow a single surfboard to use multiple brands of surfboard fins.

Brief Description of Invention

The invention has particular application to a surfboard fin fixing system, and for illustrative purposes, reference will be made to such application. However, this invention may also apply to the fixing or attachment of fins to other aquafoils such as surf skis or the like.

History of the Invention

From about 1948 onwards, fins have become an almost universally affixed feature of surfboards, but in more recent times, removable fins have dominated over fins which are permanently fixed in place. There have been several attempts to provide systems for fixing fins to surfboards, but many suffer from drawbacks, including complexity, lack of mechanical strength, requirement for tools, and lack of interoperability between different systems.

Prevalent amongst the fin fixing systems is the use of a fin box which is permanently fixed into the surfboard and which provides a slot into which tabs, flanges or similar types of protrusion extend. Mechanical arrangements for the fixing of the fin in the fin box have varied considerably, mostly in similar fashion to those marketed by Fin Control Systems Pty Ltd (FCS), a system which evolved from the provision of slotted plugs in which the slot received one of two or more tabs of a fin. Because of the popularity of FCS fins, it would be advantageous if new fin fixing systems were mechanically compatible with FCS fins. While this application uses the brand names "FCS" and "Futures", it is intended to cover any use of any fin that is constructed to fit into any type of fin box traditionally associated with either the FCS or Futures line of fins.

Surfboards are generally ridden in a particular direction and for reference purposes, the following terminology is used in this specification for convenience of reference, particularly with regard to the direction and relative positions of elements of the invention, unless the context indicates otherwise. "Longitudinal" refers to the dimension extending from the bow to the stern, or the front to the rear, of the surfboard. "Abeam" refers to the dimension extending across the surfboard substantially at right angles to the longitudinal axis and in substantial alignment with the deck or upper face of the surfboard. "Transverse" refers to the dimension substantially at right angles to the other two dimensions. The terms "above" and "below" refer to the surfboard in its normal orientation with the fins extending downwards below the surfboard unless the context indicates otherwise and are not to be taken as limiting the surfboard to any particular orientation. When fins and fin systems are illustrated separately from the surfboard, the orientation is often upside down—that is, pointing upwards, and the fins illustrated in accordance with the present invention are also illustrated in such orientation.

The present invention aims to provide a surfboard fin fixing system which alleviates one or more of the above drawbacks and provide a surfboard with fins attached in a way which will be reliable and efficient in use. Other aims and advantages of the present invention may become apparent from the following description.

A typical fin box is an elongate fin box fixable in a surfboard aligned substantially along or at an acute angle beside the longitudinal axis of the surfboard, the fin box having a slot extending longitudinally and having a forward end, a rearward end, a base wall and two opposed substantially parallel side walls and an outer face intended to be substantially aligned with the lower face of a surfboard, the opening of the slot being at the outer face. Unless the context indicates otherwise, fin boxes substantially of this form will be referred to herein as fin boxes as herein described.

Background Art

Surfboards have had variations of detachable fin systems since the 1960's. The earlier variations made use of the single fin placed in a channel, later versions provided means for attaching and detaching fins Some of these aforementioned later versions used screws to directly or indirectly hold the fin in place i.e. U.S. Pat. No. 5,328,397 (WHITTY), WO 99/21755 (PAT-TECH Pty Ltd), U.S. Pat. No. 6,386,933 (REWALD et al), AU 2002 34367 (MACNAMARA MARKETING Pty Ltd), U.S. Pat. No. 5,830,025 (FLEMING). These required a tool of sorts to engage the screw and thus retain the fin into position. Sometimes the tightening of the screw created pressure whereby the box was eventually split apart by extensive pressure. Other times the requirement to overcome this splitting means that the box is created so strong that weight becomes an issue. This became apparent with a previous application by the author.

Some systems use a version of design that has a form of 'cam' to retain the fin into place i.e. US 20030124924 (McCAUSLAND).

Other systems i.e. U.S. Pat. No. 5,649,846 (DAVEY), US20030087564 (KELLEY) use pressure and clips means to retain the fin in place. This meant that the fin had to be made specific to the box creating a marketing problem as spares had to be available all over the world and no other fins could fit into the fin box.

Most of the aforementioned versions required access from the side of the fin cavity to engage means to retain the fin in place this required a substantial side component to the fin box to allow this access.

Some versions retain the fin from the leading edge of the fin via screw or clip means. This meant that the fin box was required to be longer than the fin to gain access to the screws or clips and allow access for the fin via a rotation and insertion into the box.

Pressure alone will not hold the fin into place as varying side pressures will eventually loosen the fin over time meaning the loss of the fin or, to prevent this happening, the fin has to be placed into the cavity with such force that it is almost impossible to remove. One system overcame this by having an extension of the fin extend via a channel through to the top of the board. This led to problems with the surfers as the hole created a structural weak point for the surface of the board as well as a potential weak point for the tail as the channel extending through the board had to remove part of the "stringer" (longitudinal central strengthening device) thereby weakening the tail of the board.

The difficulty for any fin system is to provide an easy system whereby no tools are required and pressure alone will retain the fin into position whilst providing a maximum of retention of the fin whereby a minimum of force is place onto the box (or retention mechanism) to retain the fin in place. Weight considerations mean that the size of the fin box is kept to a minimum and the ability to be able to place other systems fins or easily make replacement fins for the fin box is desirable.

The issue for some fin systems is that the required dimensions for the box once mounted in to the board is such that a long channel in the box is needed this creates the problem that the side walls of the box can flex and eventually open over time. U.S. Pat. No. 5,830,025 (FLEMING) overcomes this with large flanges but his creates another problem in the aesthetics and fitting of the system to the board. U.S. Pat. No. 5,328,397 (WHITTY) overcomes this by having two boxes per fin with small limited longitudinal side walls thus limiting the opening but this has created problems as the size of the boxes has not given enough lateral strength once inside the board and added lateral pressure from the screw means can sometimes cause the box to fail.

The use of springs is desirable but simple mechanical springs i.e. coil and leaf springs made of either metals or plastics materials have limitations. Metals can rust and both forms require substantial size to produce a suitable opposing force. As mentioned prior, size and weight of a fin box are important considerations.

With the foregoing objects in view, this invention in one aspect resides broadly in a fin fixing system including:

a fin having one or more fin tabs for insertion into the slot of a fin box as herein described, the one or more tabs having a distal end face, and being tapered at a selected angle towards the distal end face.

an elongate wedge sized for insertion into the slot substantially along the length thereof and having a slot engaging face and a tab engaging face at an angle to the slot engaging face, hereinafter referred to as the wedge angle, the wedge angle being substantially commensurate with the selected angle of the taper of the tabs of the fin such that relative movement between the wedge and the tabs results in expansion of the dimension abeam thereof for tight engagement of the tabs and the wedge in the slot of the fin box.

An adaptor may also be provided, being sized to fit into an alternative fin box and having a slot of substantially the same form as that of the fin box hereinbefore described, the alternative fin box having a channel or aperture sized to receive the adaptor.

In another aspect, this invention resides broadly in a fin fixing system including:

a fin box as herein described, the fin box further including latch means at the rear end of the slot.

an adaptor sized to fit into the slot, the adaptor having a font end and a rear end, a protrusion extending from the front end and formed to fit into the forward indentation of the slot, and complementary latch means co-operable with the latch means of the slot for retaining the adaptor in the slot.

In such form, the adaptor is arranged to receive the wedge and tapered tabs as hereinbefore described. The latch means preferably includes portions or separate parts having a resilient bias substantially lateral to the fin box, the lateral dimension being somewhat abeam to the surfboard and being set forth.

OBJECTS OF THE INVENTION

It is therefore an object of the present invention to provide. A fin box assembly for a fin fixing system, requiring no additional pieces, accessories or inserts, such that a Futures fin type channel can be configured to accommodate and secure an FCS type fin to the required cant angle.

Additional objects of the invention include. A fin box assembly for a fin fixing system, comprising: a Futures type fin channel, an FCS type fin channel created by the encroachment of a wedge into the Futures type channel moved by wedge adjustment screws where an FCS type fin can be inserted into the FCS type channel, and a Futures type fin can be inserted into the Futures type fin channel when the wedge is retracted.

Further objects of the invention include, variations in the activation and adjustment of the wedge used to alter the channel to accommodate either Futures fins or FCS fins.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

In order that this invention may be more readily understood and put into practical effect, reference will now be made to the following drawings which illustrate several preferred embodiments of the invention, and wherein:

BRIEF DESCRIPTION OF THE FIGURES

One preferred form of the invention will now be described with reference to the accompanying drawings.

REFERENCE NUMBERS USED

Figure 1:
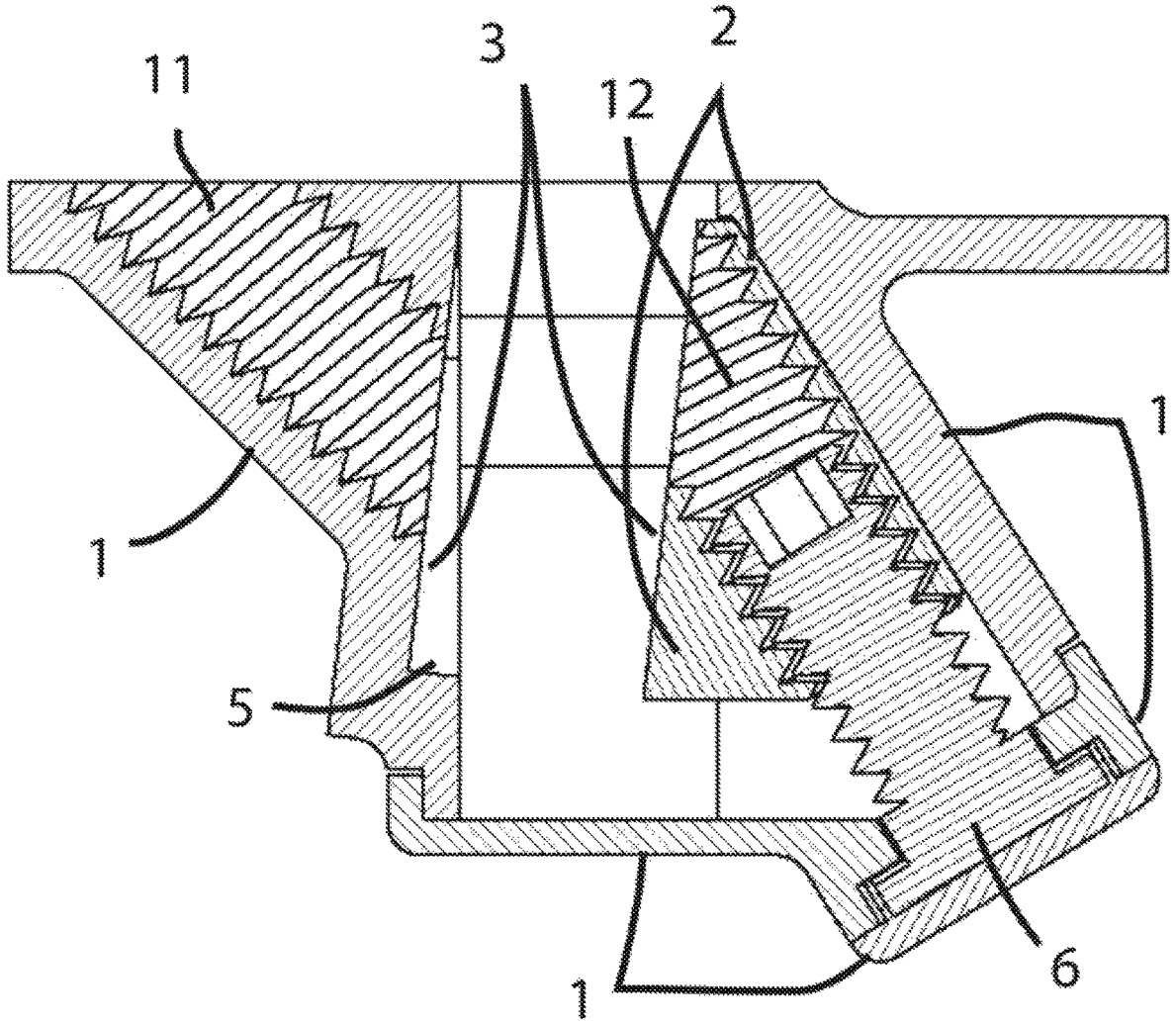
FIG. 1 is a lateral cross section of a fin fixing system according to the invention having a fin box which includes hollow sections.

1. Box
2. Wedge
3. Channel created for FCS
4. Cavity for Futures
5. Indent for FCS to create angle
6. Wedge adjustment screw
7. Grub screw
8. FCS fin
9. FCS fin base
10. Futures fin base
11. Grub screw hole
12. Wedge screw access
13. Futures fin
14. Futures fin angle at base
15. FCS fin no angle at base
16. Angled lock screw hole
17. Sawtooth adjustment screw
18. Longitudinal adjustment plate
19. Sawtooth wedge
20. Sawtooth Adjustment screw hole
21. Sawtooth box body
22. Clip/latch/button
23. Spring material
24. Cavity
25. Cap
26. Engagement point
27. Fin
28. Spring
29. Surfboard body
30. Fin
31. Fin base with clip/latch/button
32. Width extension wedge
33. Wedge adjustment screw
34. Wedge adjustment nut
35. Wedge adjustment bolt
36. Fin base with wedge taper
37. Wedge adjustment screw cavity
38. Clip/latch/button recess
39. Cavity to accept fin base
40. Box clip engagement lip
41. Fin base with longitudinal taper
42. Longitudinal width extension wedge
43. Engagement surface
44. Wedge outer surface
45. Box inner surface
46. Slot
47. Capture Spigot
48. Bottom Pegs
49. Box Bottom surface

DETAILED DESCRIPTION OF THE FIGURES

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is a lateral cross section of a fin fixing system according to the invention. The general concept behind this fin box is that through the movement of basically five screws and a wedge, a single fin box can handle fins from both FCS and Futures. There are no inserts needed or anything else to adhere to a fin or insert into the fin box the box; the fin box comes with everything a surfer needs to use either an FCS or a Futures fin. The fin box, 1 shows the parallel channel 3 created by the encroachment of the wedge 2 and the indent 5 for the acceptance of an FCS fin base. The wedge 2 can be adjusted by the wedge adjustment screw 6 which lies in a wedge screw access 12. On the other side of the fin box 1 is a grub screw hole 11 in which a grub screw 7 can be placed, which can be used to exert pressure on the other side of the fin thus retaining the fin in place.

Figure 2:
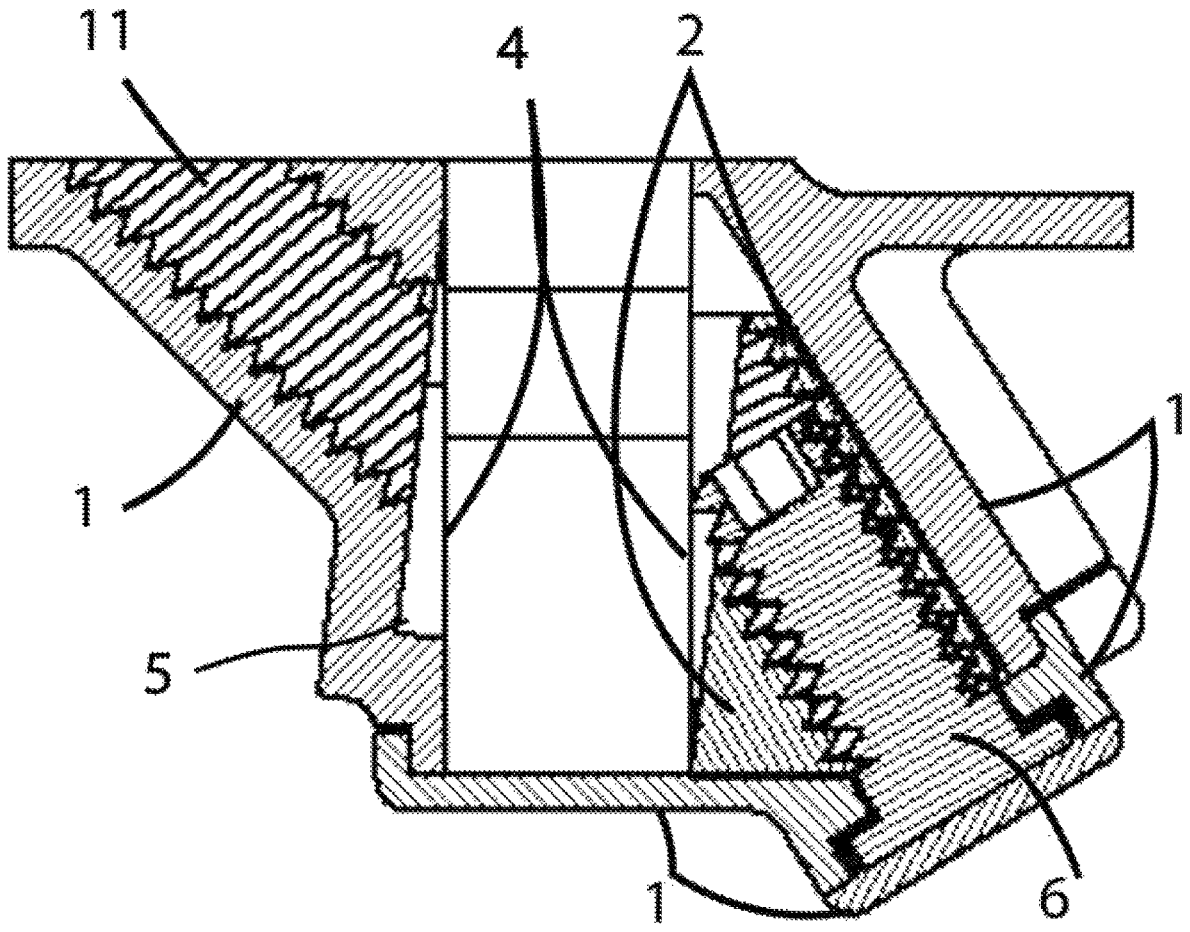
FIG. 2 is a lateral cross section of the fin fixing system of FIG. 1 wherein the fin box does not include the hollow sections.
Figure 6:
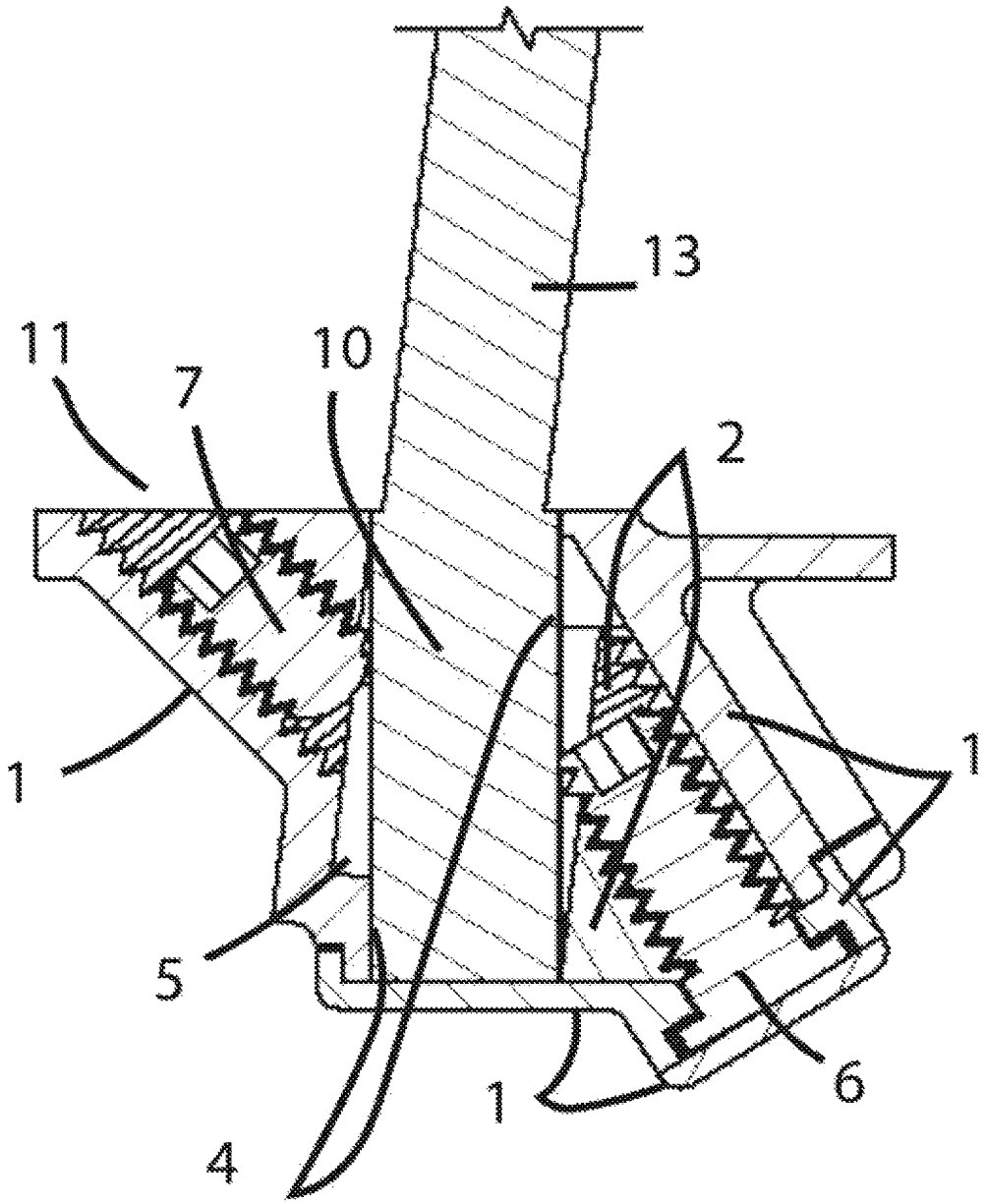
FIG. 6 is a lateral cross section a canted fine in the fin fixing system of FIG. 1 with an alternative adaptor and latch means, showing the fin or adaptor in the slot.

FIG. 2 is a lateral cross section of the fin fixing system according to the invention. In this figure, the wedge 2 has been retracted from an active position through the screwing "down" of the wedge adjustment screw 6 which rests in the wedge screw access 12. Due to the retraction of the wedge 2 the parallel channel 4 now becomes available for the acceptance of a Futures fin base as shown in FIG. 6.

Figure 3:
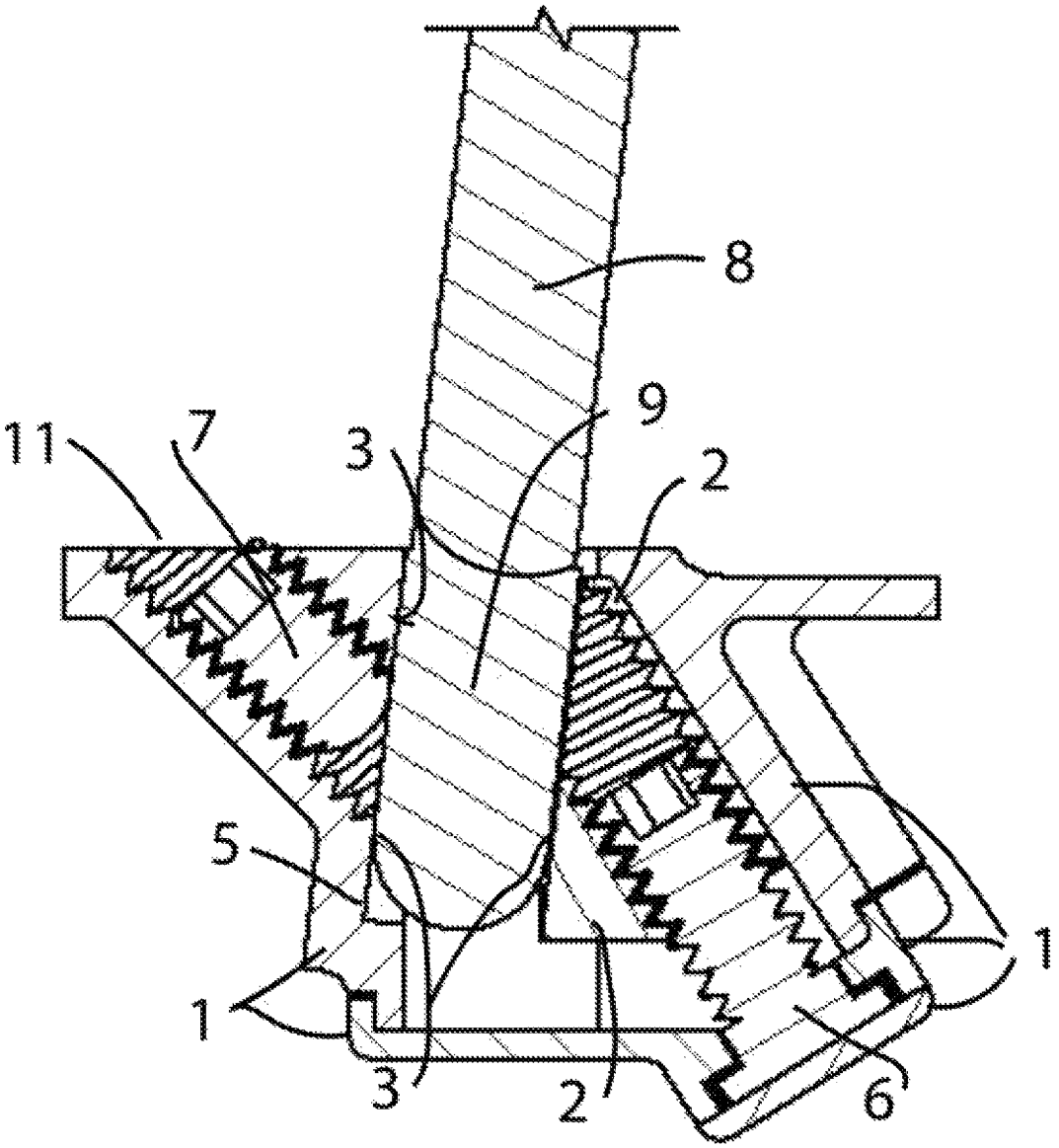
FIG. 3 is a lateral cross section of the fin fixing system of FIG. 1 and incorporating an adaptor and latch means.

FIG. 3 is a lateral cross section of the fin fixing system shown in FIG. 1. With an FCS fin 8 and Base 9 inserted into the fin box 1. The FCS fin base 9 resides in the parallel channel 3 created by the indent 5 and the wedge 2. The grub screw 7 is exerting pressure on the FCS fin base 9 to keep it in the channel 3. Wedge 2 has been activated by the wedge adjustment screw 6 and in cooperation with the indent 5 the channel 3 creates the required cant angle for FCS fin 8. Thereby creating the required cant angle for the FCS fin 8

Figure 4:
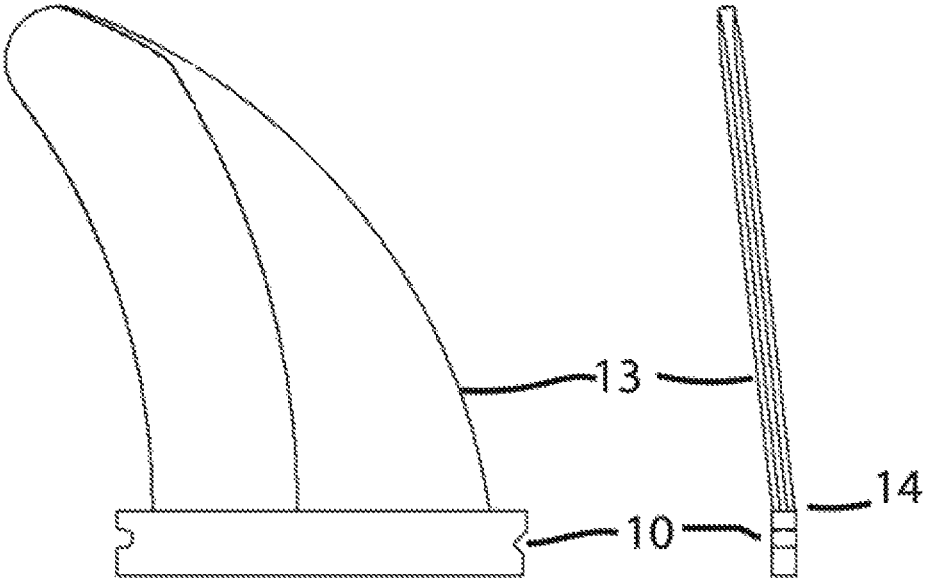
FIG. 4 is a longitudinal cross section of a canted fin in the fin fixing system according to the invention.

FIG. 4 is a side and front view representation of a typical Futures fin 13 indicating the cant angle 14 between the fin 13 and base 10. canted fin in the fin fixing system according to the invention. A Futures fin 13 has been inserted into the Futures fin base 10, which has created a Futures fin angle at base 14.

Figure 5:
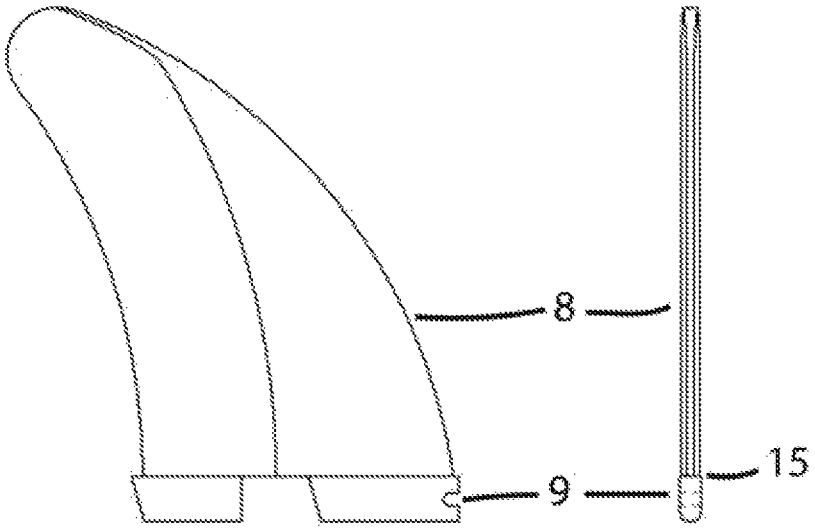
FIG. 5 is a longitudinal cross-sectional view of an upright fin.

FIG. 5 is a side and front view representation of a typical FCS fin 8 with and FCS fin base 9 which indicates an FCS fin with no cant angle at base 15.

FIG. 6 is a lateral cross section of the fin fixing system shown in FIG. 2. With The Futures fin 13 and base 10 inserted into the fin box 1. The Futures fin 13 has a canted angle, such that the Futures fin base 10 is not parallel to the direction of the Futures fin 13. The wedge 2 has been pulled back and down, by wedge adjustment screw 6 such that the channel 4 is available for the acceptance of the Futures base 10. Force from the grub screw 7 holds the fin 13 in place.

Figure 7:
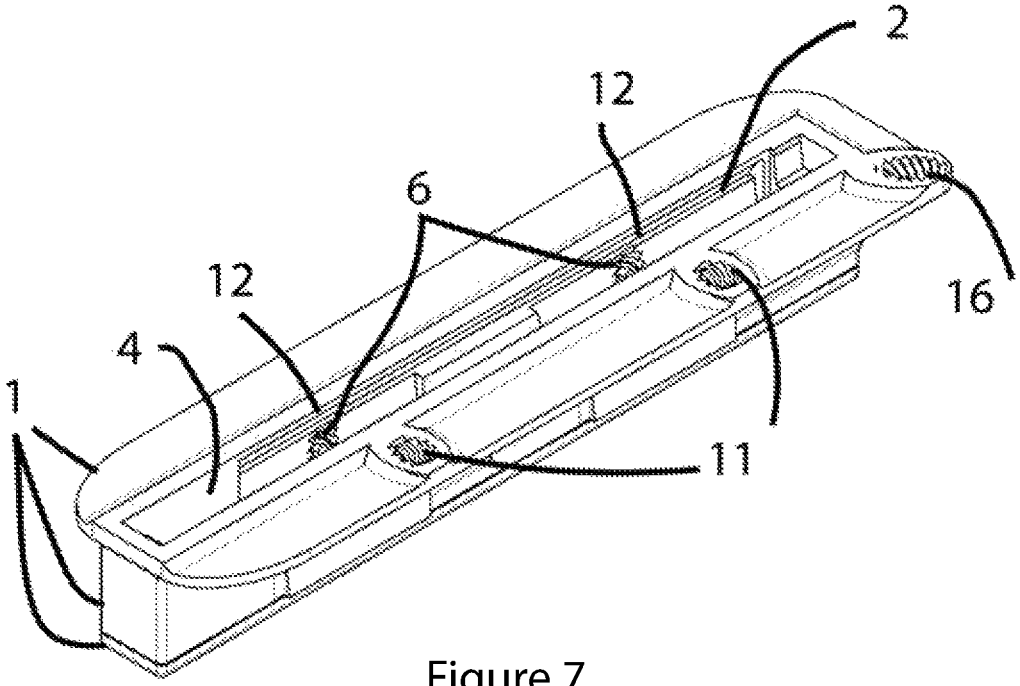
FIG. 7 is a top, perspective view of the fin fixing system of FIG. 6 showing the fin or adaptor not in the slot.

FIG. 7 is a top, perspective view of the fin fixing system of FIG. 6 showing the fin or adaptor not in the slot. On one side of the fin box 1 is the wedge 2 and wedge adjustment screws 6. On the other side are two grub screw holes 11 and an angled lock screw hole 16 which functions to provide access for a further grub screw to lock in the leading edge of the fin.

Figure 8:
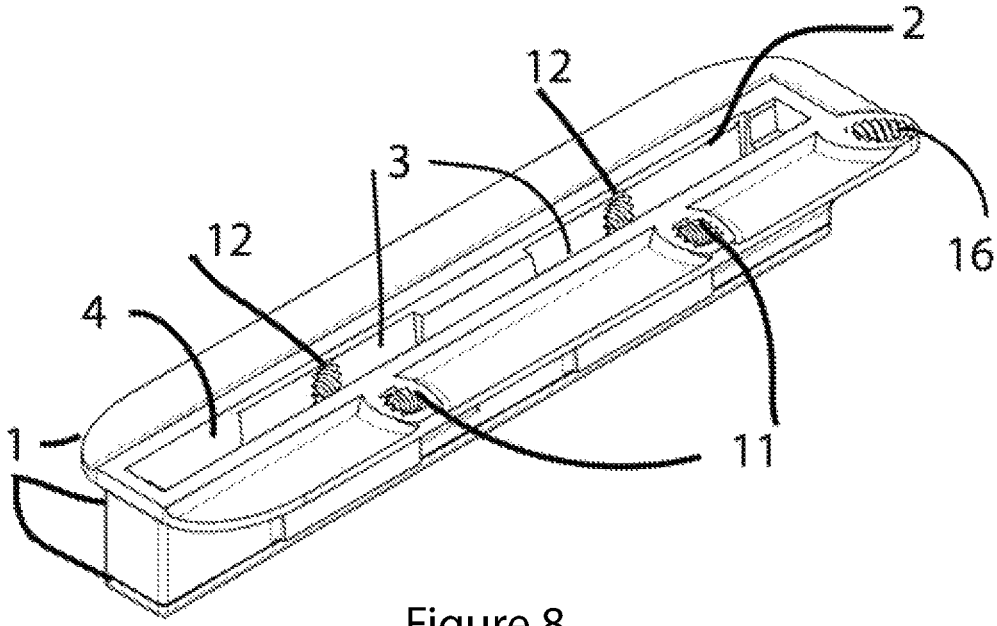
FIG. 8 is a top, perspective view of the fin fixing system of FIG. 7 showing the fin or adaptor not in the slot.

FIG. 8 is a top, perspective view of the fin fixing system of FIG. 7 showing the fin or adaptor not in the slot. This figure is identical to FIG. 7, except that the wedge 2 has been extended in this figure.

Figure 9:
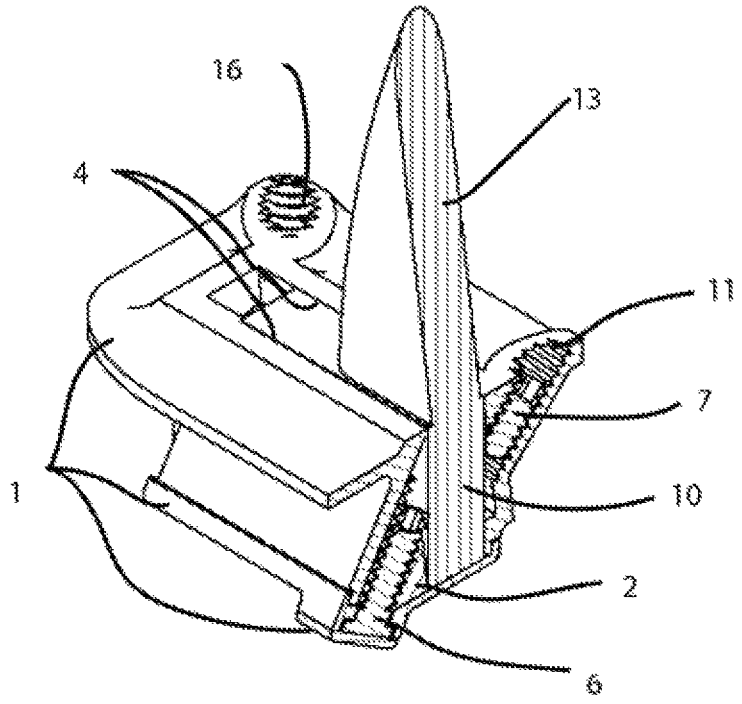
FIG. 9 is a side, perspective view of an FCS fin being restrained in a fin box.

FIG. 9 is an angled perspective view of FIG. 6 of a Futures fin 13 being restrained in the fin box 1. The Futures fin 13 has a canted angle, such that the Futures fin base 10 is not parallel to the direction of the Futures fin 13. The wedge 2 has been pulled back and down, by force from the grub screw 7 holds the fin in place.

Figure 10:
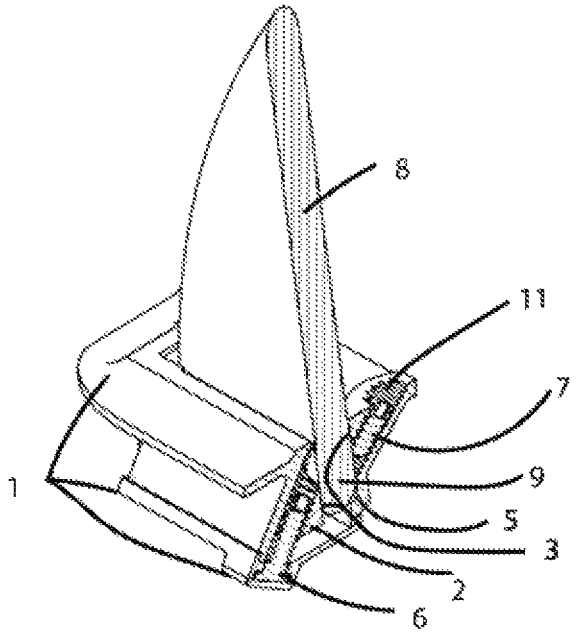
FIG. 10 is a side, perspective view of a Futures fin being restrained in a fin box.

FIG. 10 is a an angled perspective view of FIG. 3 of an FCS fin 8 and base 9 being restrained in a fin box 1. The FCS fin base 9 resides in the parallel channel 3 created by the indent 5 and the wedge 2. The grub screw 7 is exerting pressure on the FCS fin base 9 to keep it in the channel 3. Wedge 2 has been activated by the wedge adjustment screw 6 and in cooperation with the indent 5 the channel 3 creates the required cant angle for FCS fin 8. Thereby creating the required cant angle for the FCS fin 8.

Figure 11:
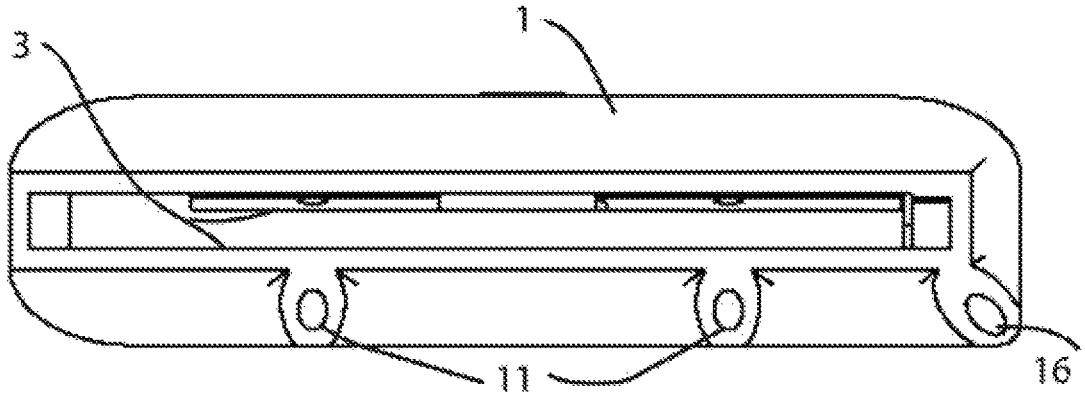
FIG. 11 is top view of the channel created for an FCS fin without the fin in the box.

FIG. 11 is top view of the channel created for an FCS fin without the fin in the box. The wedge 2 is shown as encroached into the channel by the wedge adjustment screws (not shown) creating the required specifications in channel 3 for the insertion of an FCS fin.

Figure 12:
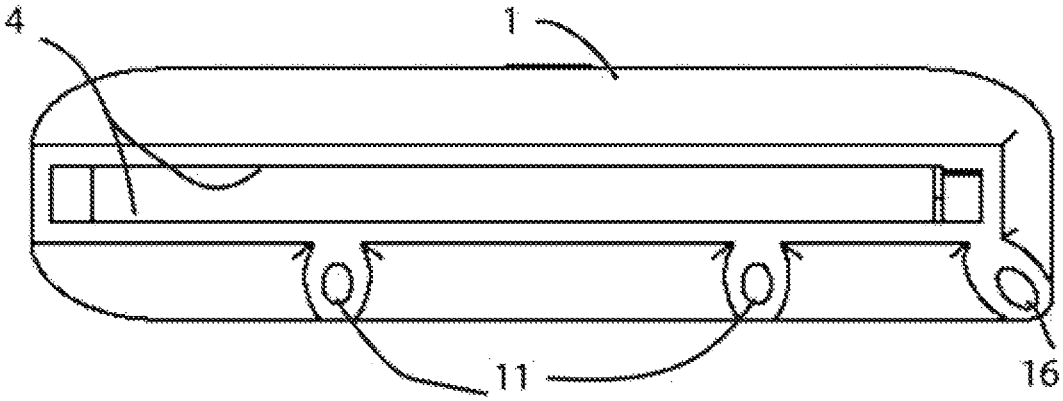
FIG. 12 is a top view of the channel created for a Futures fin without the fin in the box.

FIG. 12 is a top view of the channel 4 for a Futures fin without the fin in the box. It shows the channel 4 available for insertion of a Futures fin without the fin in the box. The channel 4 is shown without the wedge 2 of FIG. 11.

Figure 13:
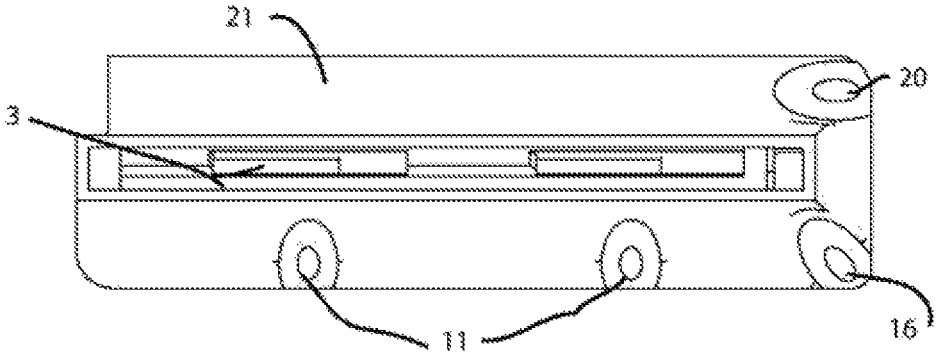
FIGS. 13 through 14 are top views of an alternate embodiment of the fin box.
Figure 14:
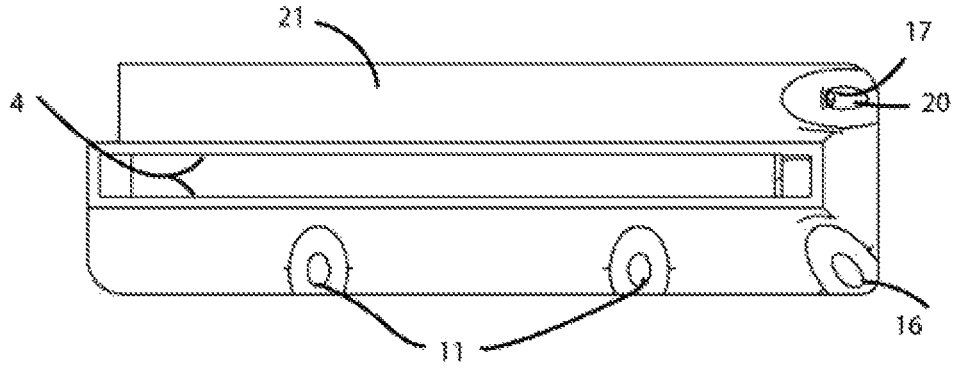

FIGS. 13 through 14 are top views of an alternate embodiment of the fin box.

Figure 15:
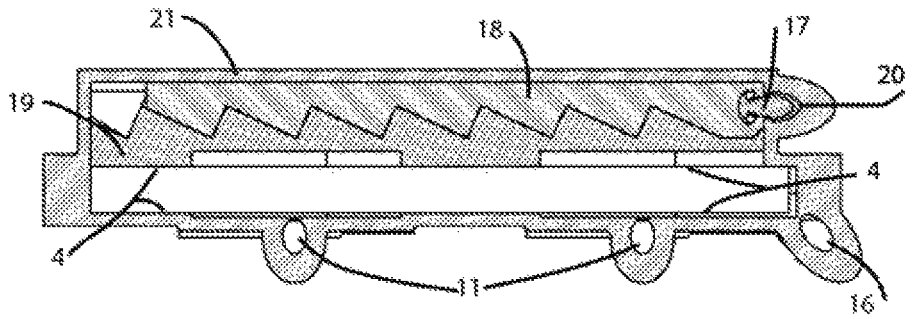
FIG. 15 is a top view of yet another embodiment of the fin box.

FIG. 15 is a top view of yet another embodiment of the fin box.

Figure 16:
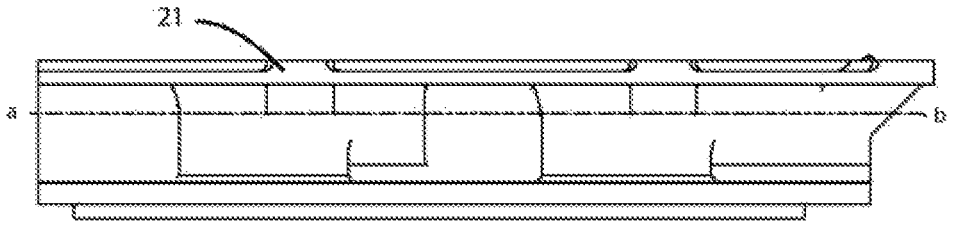
FIG. 16 is a side view of yet another embodiment of the fin box.

FIG. 16 is a side view of yet another embodiment of the fin box.

Figure 17:
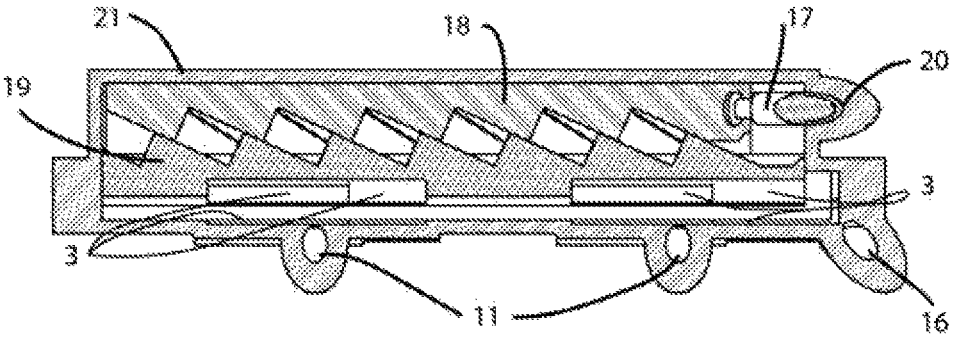
FIG. 17 is a top view yet another embodiment of the fin box.

FIG. 17 is a top view yet another embodiment of the fin box.

Figure 18:
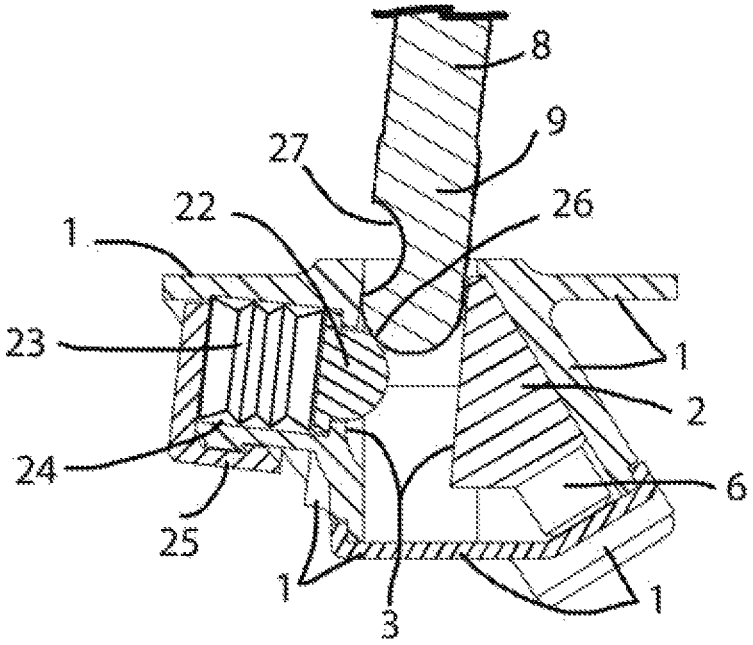
FIG. 18 is a cross-sectional view of one embodiment of the invention.

FIG. 18 is a cross-sectional view of one embodiment of the invention. Drawing 18 indicates the FCS type fin 8 and base 9 being inserted into the box 1 the fin engages the clip/latch/button 22 at the engagement point 26 that starts pushing the clip/latch/button 22 into the cavity 24 compressing the resilient/compressible material 'spring' 23 (shown un-compressed). The cap 25 provides an assembly access to the cavity 24. The channel 3 is provided by the wedge 2 being in the up position after being adjusted by the adjustment screw 6.

Figure 19:
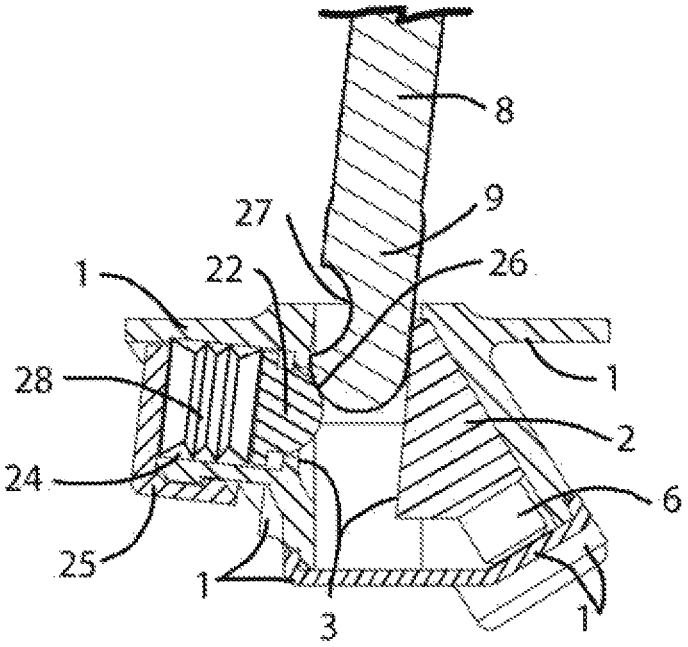
FIG. 19 is a cross-sectional view of one embodiment of the invention.

FIG. 19 is a cross-sectional view of one embodiment of the invention. Drawing 19 shows the fin 8 and base 9 encroaching further into the channel 3 and moving the clip/latch/button 22 further into the cavity 24 and compressing the 'spring' 28 (shown being compressed therefore different number).

Figure 20:
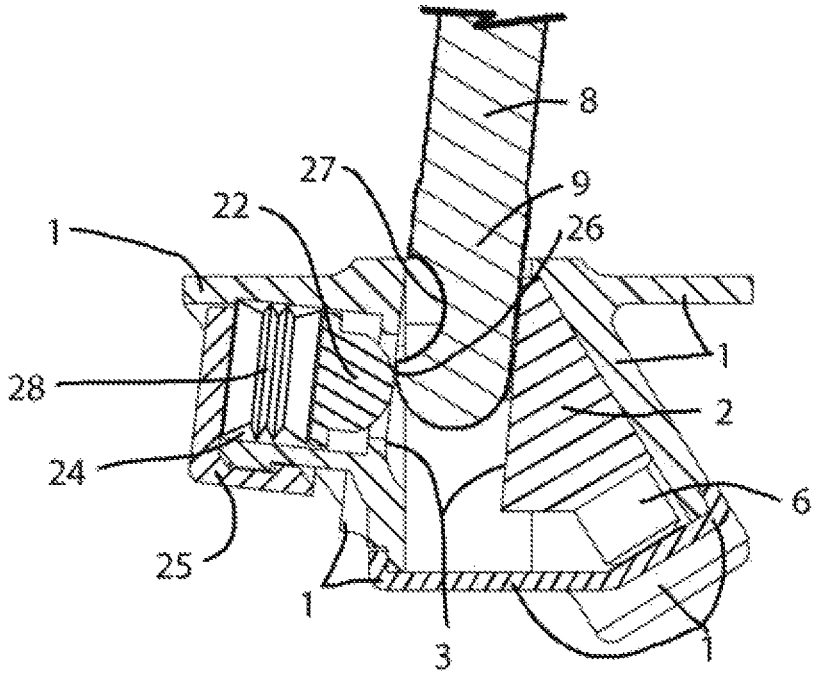
FIG. 20 is a cross-sectional view of one embodiment of the invention.

FIG. 20 is a cross-sectional view of one embodiment of the invention. Drawing 20 shows the fin 8 and base 9 encroaching to the point whereby the engagement point 26 is compressing the 'spring' 28 to maximum compressed state.

Figure 21:
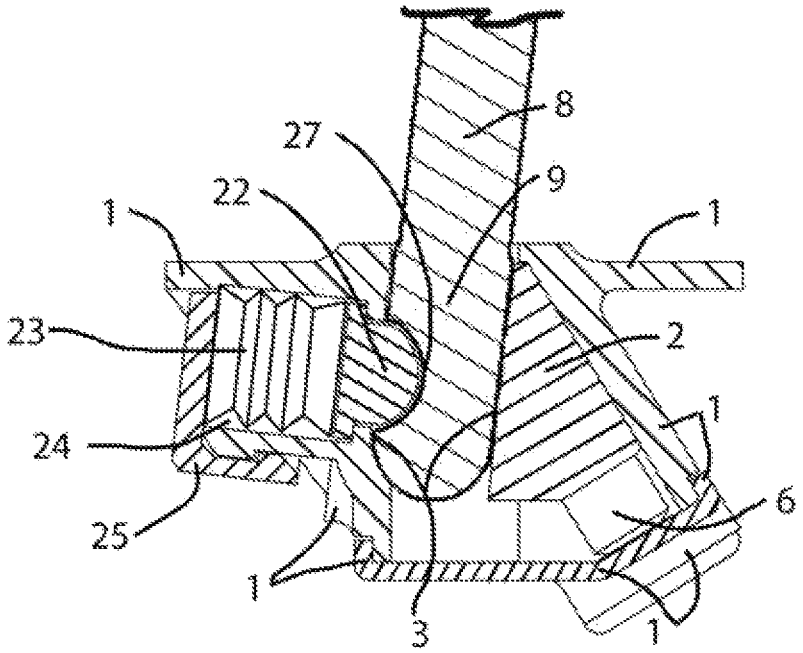
FIG. 21 is a cross-sectional view of one embodiment of the invention.

FIG. 21 is a cross-sectional view of one embodiment of the invention. Drawing 21 show the fin 8 and base 9 having being fully inserted into the channel 3 and the 'spring' 23 now fully un-compressed pushing the clip/latch/button 22 into the channel and occupy the space in the fin 27 thus locking the fin into place.

Figure 22:
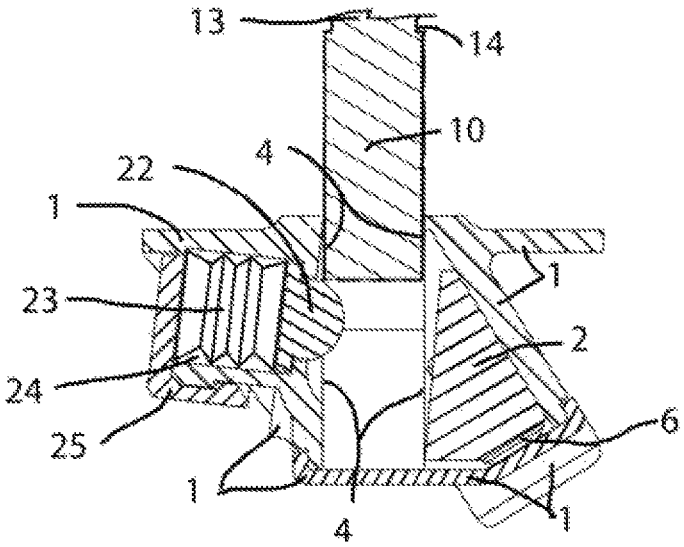
FIG. 22 is a cross-sectional view of one embodiment of the invention.

FIG. 22 is a cross-sectional view of one embodiment of the invention. Drawing 22 indicates Futures type fin 13 and base 10 being inserted into the channel 4 created by the withdrawal of wedge 2 by adjustment screw 6

Figure 23:
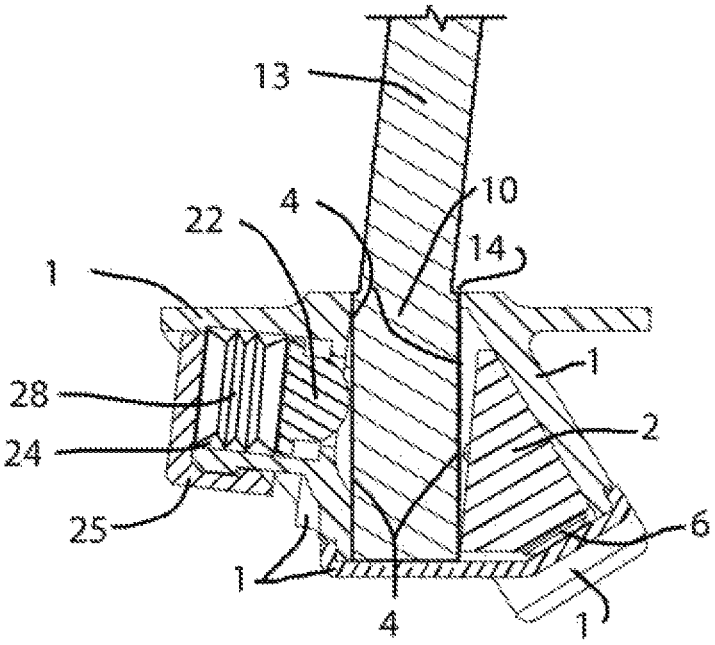
FIG. 23 is a cross-sectional view of one embodiment of the invention.

FIG. 23 is a cross-sectional view of one embodiment of the invention. Drawing 23 indicates the Futures type fin 13 and base 10 fully inserted into the channel 4 and showing the clip/latch/button pressed into the cavity 24 and compressing the 'spring' (indicated as 28) allowing the full insertion of the fin.

Figure 24:
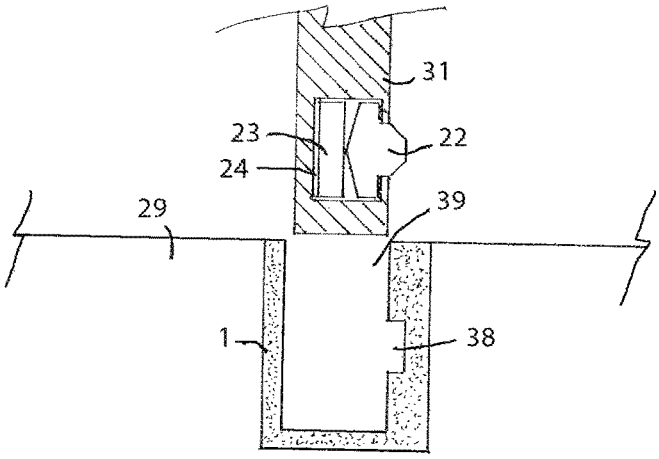
FIG. 24 shows in part lateral cross section the surfboard body 29 with fixedly mounted fin box 1 and fin 31 with clip/latch/button 22 prior to insertion into cavity of box 39.

FIG. 24 shows in part lateral cross section the surfboard body 29 with fixedly mounted fin box 1 and fin base 31 prior to insertion into cavity of box 39 with laterally mounted clip/latch/button 22 is shown in extended position with spring material 23 in non-compressed state in cavity 24.

Figure 25:
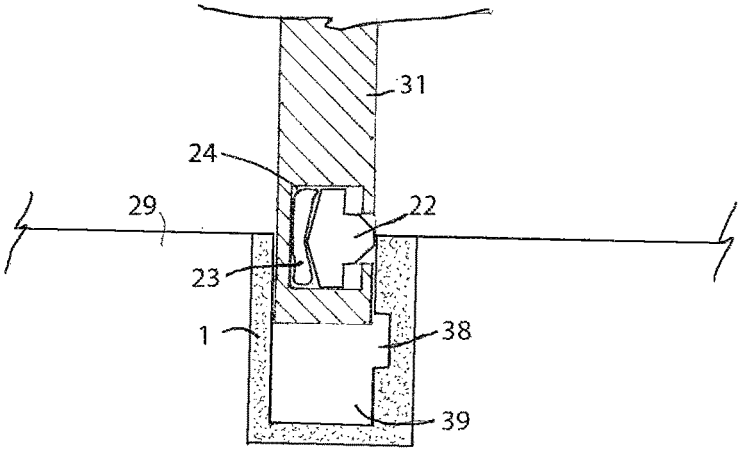
FIG. 25 shows in part lateral cross section the surfboard body 29 with fixedly mounted fin box 1 and fin 31 with clip/latch/button 22 partially inserted into cavity of box 39.

FIG. 25 shows in part lateral cross section the surfboard body 29 with fixedly mounted fin box 1 and fin base 31 with laterally mounted clip/latch/button 22 partially inserted into cavity of box 39 compressing and causing spring material 23 to distort into cavity 24 allowing clip/latch/button to move allowing fin to be inserted into cavity 39.

Figure 26:
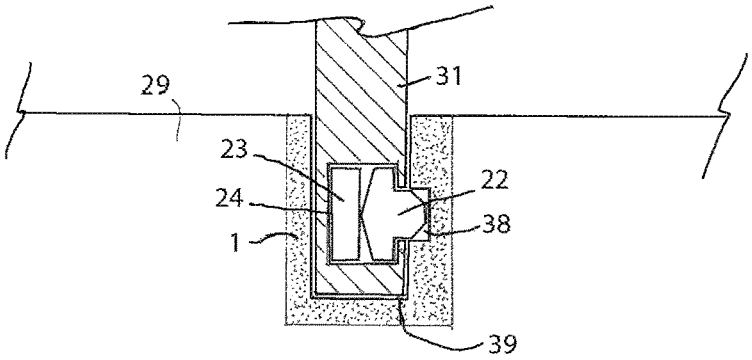
FIG. 26 shows in part lateral cross section the surfboard body 29 with fixedly mounted fin box 1 and fin 31 with clip/latch/button 22 fully inserted into cavity of box 39.

FIG. 26 shows in part lateral cross section the surfboard body 29 with fixedly mounted fin box 1 and fin base 31 with laterally mounted clip/latch/button 22 fully inserted into cavity of box 39 the clip/latch/button 22 has returned to extended position by resilience of spring material 23 aligning clip/latch/button 22 into clip/latch/button recess 38 retaining fin and fin base 31 in box 1 until desired removal.

Figure 27:
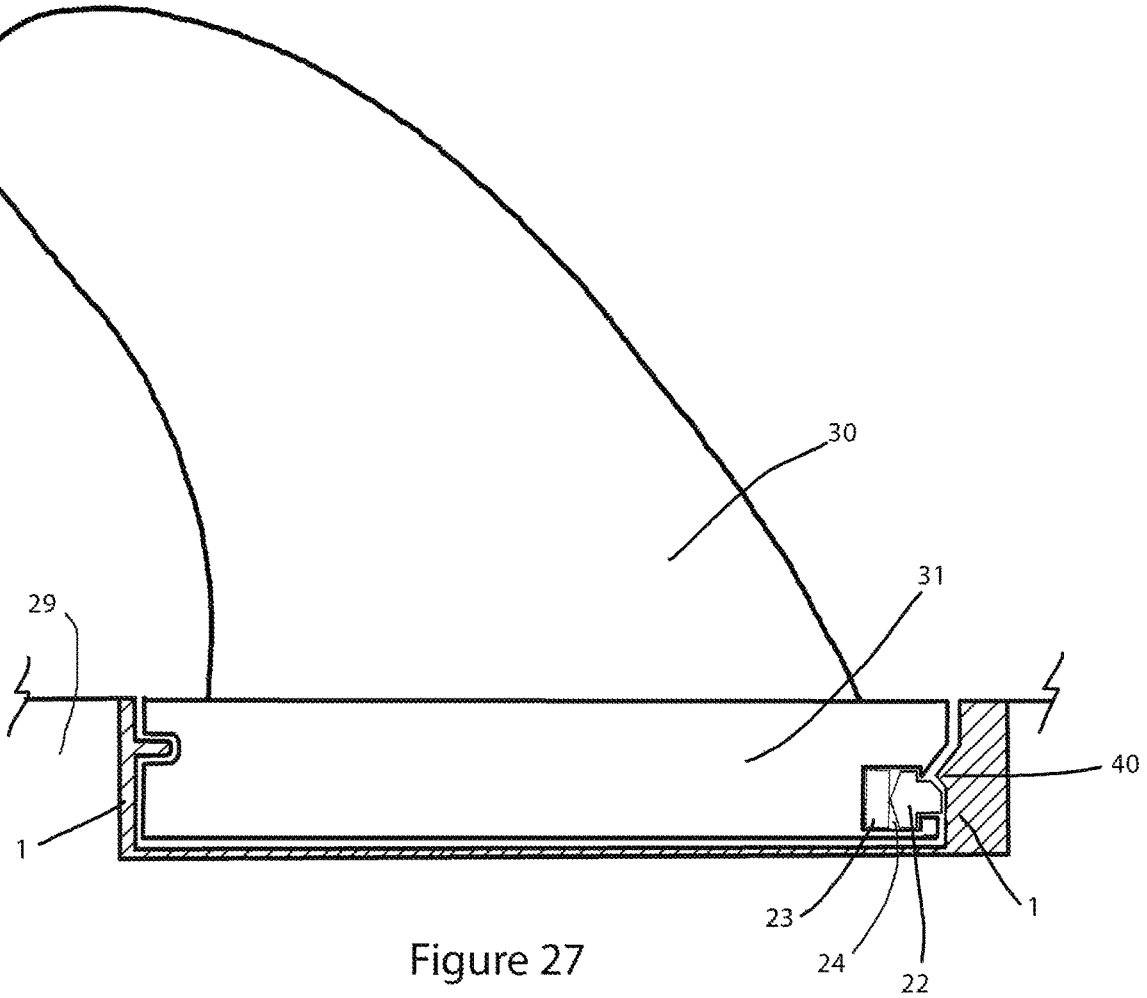
FIG. 27 shows in part longitudinal cross section of the surfboard body 29 with fixedly mounted fin box 1 and fin 30 with fin base 31 with clip/latch/button 22 inserted into fin box 1.

FIG. 27 shows in part longitudinal cross section the surfboard body 29 with fixedly mounted fin box 1 and fin 30 with fin base 31 with longitudinally mounted clip/latch/button 22 engaged with box clip engagement lip 40 or other means retaining fin base 31 in box 1 with pressure derived from pressure from spring material 23.

Figure 28:
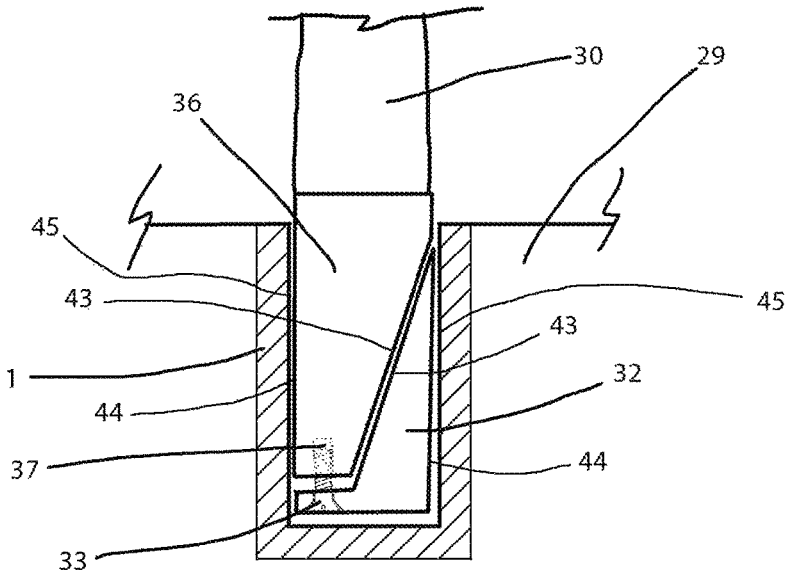
FIG. 28 shows in part lateral cross section the surfboard body 29 with fixedly mounted fin box 1 and fin 30 with fin base with wedge taper 36 with attached width extension wedge 32.

FIG. 28 shows in part lateral cross section the surfboard body 29 with fixedly mounted fin box 1 and fin 30 with fin base with wedge taper 36 attached to width extension wedge 32 by wedge adjustment screw 33 inserted and retained by the wedge adjustment screw cavity 37 adjustment of wedge adjustment screw 33 causes the wedges to touch at the engagement surfaces 43 causing the wedge outer surfaces 44 to expand laterally increasing pressure upon the box inner surfaces 45 allowing for adjustment of pressure between wedge outer surfaces 44 and box inner surfaces 45 thus alleviating any undesired movement between the fin base 36 and the fin box 1.

Figure 29:
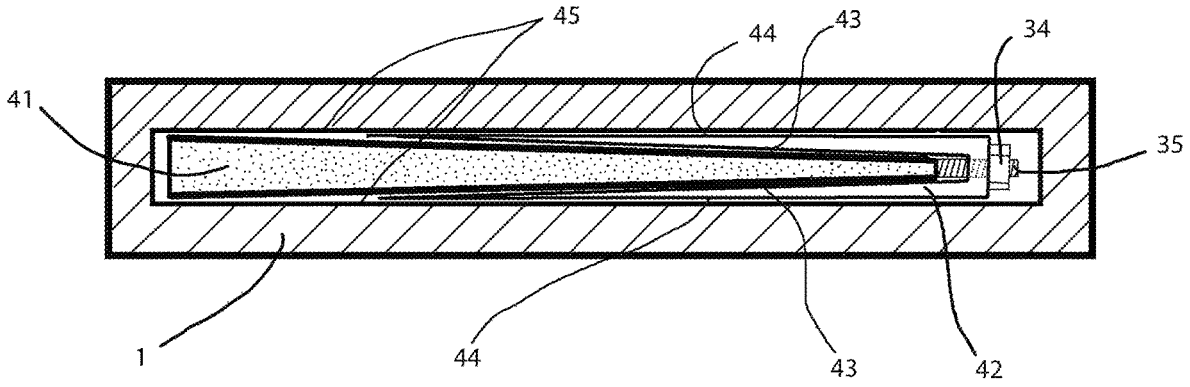
FIG. 29 shows in part longitudinal cross section a fin box 1 with fin base 41 and wedge adjustment bolt 35 with longitudinal taper and longitudinal width extension wedge 42 adjusted by adjustment nut 35.

FIG. 29 shows in part longitudinal cross section a fin box 1 with inserted fin base with longitudinal taper 41 and wedge adjustment bolt 35 extending to accept the longitudinal width extension wedge 42 and held in place by the wedge adjustment nut 34 whereby said adjustment of wedge adjustment nut 34 causes sliding of engagement surfaces 43 causing the wedge outer surfaces 44 to extend laterally and create pressure upon the box inner surfaces 45 thus alleviating any undesired movement between the fin base 41 and box 1.

Figure 30:
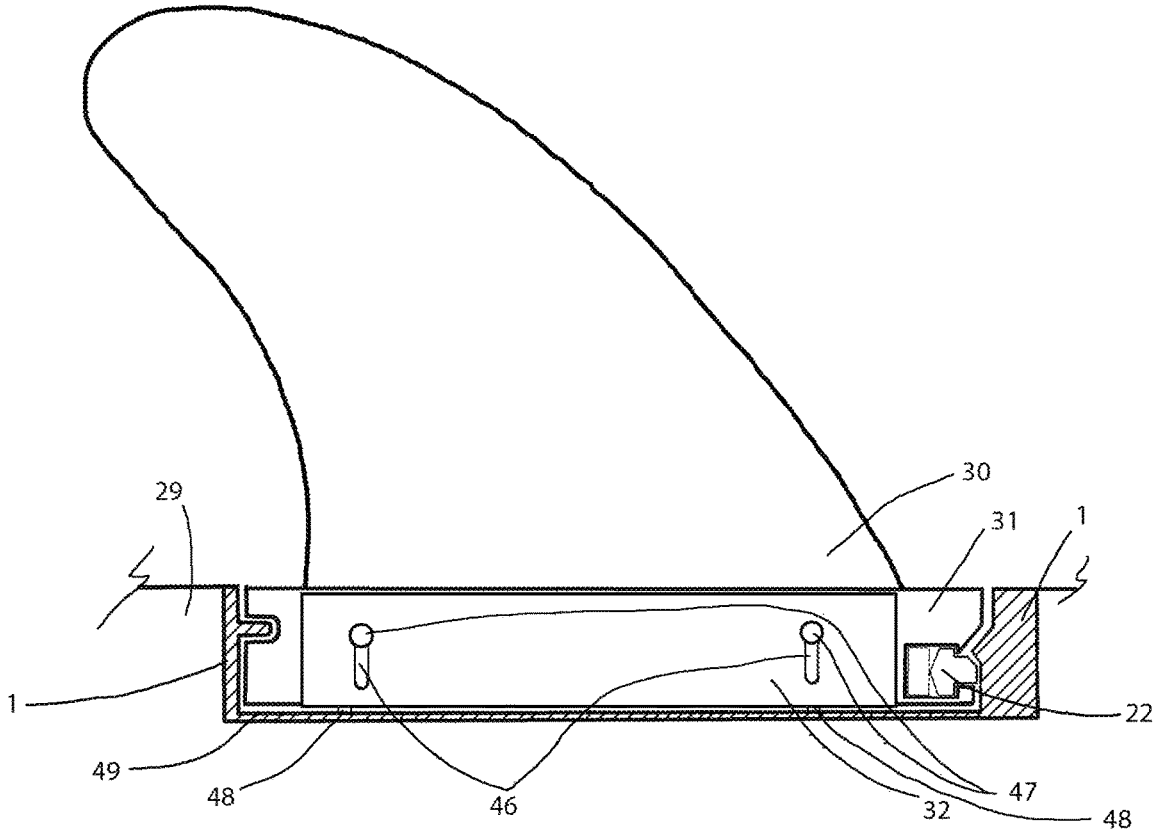
FIG. 30 shows in part longitudinal cross section a fin 30 with fin base with clip/latch/button 31 and attached width extension wedge 32 inserted into box 1.

FIG. 30 shows in part longitudinal cross section a surfboard body 29 with a fixedly mounted fin box 1 with a clip/latch/button fixing system 22 retaining the fin base 31 in the box 1 the width extension wedge 32 is shown captured by the capture spigots 47 within the slots 46 and the bottom pegs 48 are engaged with the bottom of the fin box surface 49.

Figure 31:
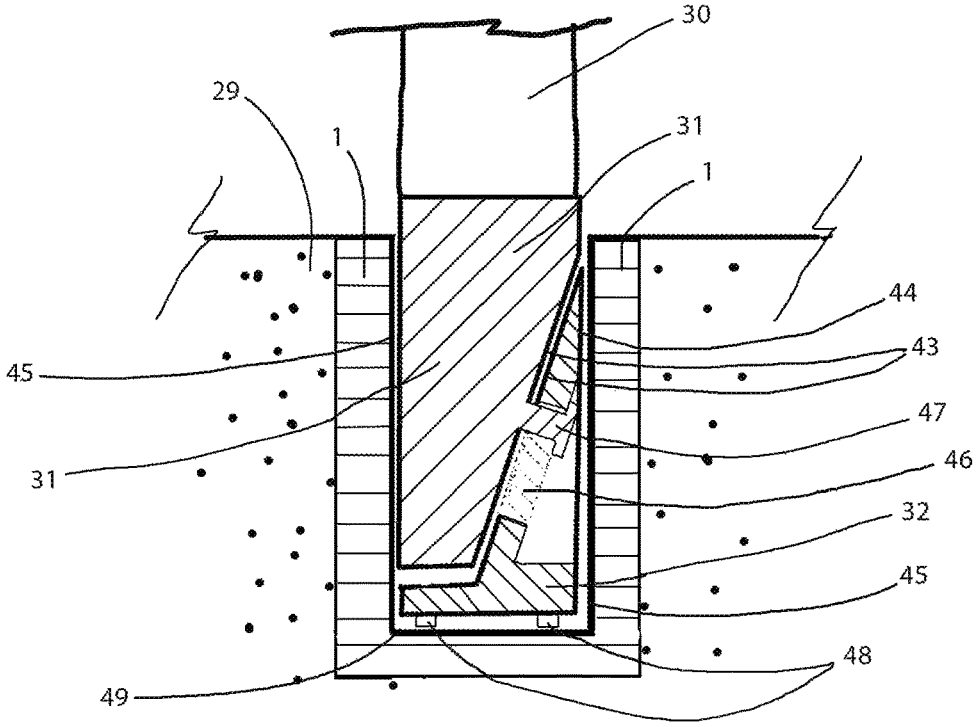
FIG. 31 shows in part lateral cross section a fin 30 with fin base 31 with width extension wedge 32 inserts into box 1.

FIG. 31 shows in part lateral cross section a surfboard body 29 with a fixedly mounted fin box 1 and a fin 30 with a fin base 31 with width extension wedge 32 captured by the capture spigot 47 the bottom pegs 48 about to engage with the bottom of the fin box 49 causing the width extension wedge to slide vertically along the slots 46 the movement causing the engagement surfaces 43 to interact and thus changing the width of the total fin base wedge dimension causing the wedge outer surface 44 to press against box inner surface 45.

It will be realized that the above is illustrative of one or more examples of the invention, and that all such modifications and variations thereto as would be apparent to persons skilled in the art are deemed to fall within the broad scope and ambit of the invention as herein set forth.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A fin box adapted to be fixedly mounted in the body of a surfboard, said fin box having at least one recess to accept at least one projection from a base of a fin to locate the fin accurately into the fin box, the fin box including at least one latch body, where the at least one latch body is extendable into the at least one recess, where the at least one latch body is impactable against at least one resilient body, where the at least one resilient body is arranged to provide a resistant force of the at least one latch body against a bearing face, where the at least one latch body can be pushed into at least one catch receptacle, where the at least one catch receptable is complimentarily located in at least one fin projection, where the at least one catch receptacle is a catch aperture, whereby the at least one latch body has a variable-shaped impact end which impacts upon at least one resilient body to affect an amount of resistance force on the at least one latch body into a recess.

2. The fin box of claim 1, whereby the at least one resilient body has a varying durometer hardness level so as to affect the amount of resistance force on the at least one latch body into the recess.

3. The fin box of claim 1 whereby the bearing face can be adjusted such as to alter a return force upon the at least one latch body by pre-loading the at least one resilient body so as to affect the amount of resistance force on the at least one latch body.

4. The fin box of claim 1, whereby the at least one resilient body has a varying shape such as to affect the return forces on the at least one latch body.

5. The fin box of claim 4 whereby the at least one resilient body is removably located in the fin box.

6. The fin box of claim 1 whereby the at least one latch body has a force-shape, where the force-shape forces a fin projection relative to the force to remove said fin projection.

7. A combination fin and fin box, where the fin has a clip nestled against a section of spring material, and the fin box has a an engagement lip, such that when the fin is pushed down into the fin box, the clip passes over the engagement lip, thereby forcing the clip back into the section of spring material, creating an opposition force in the section of spring material, such that when the clip passes over the engagement lip, the opposition force in the section of spring material forces the clip in a forward direction, thereby removably securing the fin in the fin box.

8. A combination of claim 7, where the fin has a forward clip and a section of spring material in a recess, where the fin box has a box clip engagement lip, where the forward clip is on a track, where the track is integrated into the fin, such that as the fin is pushed into the fin box, the forward clip engages the box clip engagement lip and is pushed back into recess, thereby applying a forward clip pressure on the section of spring material, whereby the section of spring material is compressed to allow the forward clip to pass the box clip engagement lip, where after the forward clip passes the box clip engagement lip, the section of spring material decompresses, thereby forcing the forward clip back into a box clip engagement lip cavity, where the box clip engagement lip cavity is located under the box clip engagement lip, thereby removably securing the fin in the fix box.

9. The combination of claim 8, where the fin has a cavity in which a section of spring material and a button sit, and where the fin box has an inner side, and were the inner side has a button recess, such that when the fin is forced in a downward direction into the fin box, the button is pushed by an upper lip of the fix box, which thereby compresses the section of spring material, such that as the fin is further pushed into the fin box such that the button comes into contact with the button recess, the section of spring material decompresses, forcing the button into the button recess and thereby removably securing the fin in the fin box.

10. A fin and wedge assembly, comprising a fin that removably connects to a wedge, where the wedge is constructed from a resilient material, such that when the fin is pushed into a fin box, a fin bottom engages the wedge, and deforms the wedge such that the fin is removably secured in the fin box; where the fin comprises a fin base with wedge taper, where the fin base with wedge taper additionally comprises a wedge adjustment screw that adjustably connects the wedge to the fin, where the wedge adjustment screw has a plurality of wedge adjustment screw threads, where the plurality of wedge adjustment screw threads mate with corresponding wedge adjustment screw cavity threads which are located in a wedge adjustment screw cavity, where the wedge adjustment screw cavity is located in a bottom portion of the fin, such that the distance between the wedge and the fin can be adjusted by turning the wedge adjustment screw, and where the wedge comprises a width extension wedge, which has a sloped wedge engagement surface that parallels a fin engagement surface on the fin, such that as the fin and the wedge are forced into a fin box, the fin engagement surface contacts the wedge engagement surface, putting an amount of pressure on the width extension wedge, and thereby wedging the width extension wedge against an inner side of the fin box.

11. The fin and wedge assembly of claim 10, where, the fin comprises a fin base with wedge, and a wedge, where the fin base with wedge additionally comprises a capture spigot that connects the wedge to the fin, where the capture spigot is placed in a slot in the wedge, and where the wedge comprises a width extension wedge, which has a sloped wedge engagement surface that parallels a fin engagement surface on the fin, such that as the fin and the wedge are forced into a fin box, the fin engagement surface contacts the wedge engagement surface, putting an amount of pressure on the width extension wedge, and thereby wedging the width extension wedge against an inner side of the fin box, where the wedge additionally comprises two or more bottom pegs, where the two or more bottom pegs serve to keep a wedge bottom from directly contacting a fin box bottom.

12. The fin and wedge assembly of claim 11, where the fin comprises at least one projection, where the at least one projection has at least one catch aperture or catch groove hole or catch groove holes to accept latch body or latch bodies.

13. The fin and wedge assembly of claim 10, comprising a fin comprising one or more projections for locating in a fin box whereby the one or more projections each include a latch body, where the latch body is extendable out of the one or more projections, said latch body impactable against a resilient body, said resilient body being arranged to provide a return force on said latch body against a bearing face, said latch body being insertable into a catch aperture complimentarily located in fin box.

14. The fin and wedge assembly of claim 13, whereby the latch body has a variable shaped impact end which impacts upon a resilient body to vary a resistance force on said latch body.

15. The fin and wedge assembly of claim 13, where the resilient body having a varying durometer hardness level so as to create a changed resistance force on the latch.

16. The fin and wedge assembly of claim 13, whereby the bearing face is an adjustable bearing face that can be adjusted so as to alter a return force upon the latch body by pre-loading the resilient body so as to change a resistance force on said latch body.

17. The fin and wedge assembly of claim 13, whereby the latch body has a latch body shape, and where the latch body shape and amount of force necessary to insert a fin projection relative to a removal force which is required to remove the fin projection from the fin box.

* * * * *